United States Patent [19]

Pries

[11] 4,001,092

[45] Jan. 4, 1977

[54] CHARGING CAR FOR COKE OVENS

[75] Inventor: Erich Pries, Bochum, Germany

[73] Assignee: Dr. C. Otto & Comp. G.m.b.H., Bochum, Germany

[22] Filed: Aug. 22, 1975

[21] Appl. No.: 606,853

[30] Foreign Application Priority Data

Nov. 8, 1974 Germany ..... 2452975

[52] U.S. Cl. ..... 202/262; 110/110; 201/40; 202/263; 214/18 PH

[51] Int. Cl.[2] ..... C10B 35/00; C10B 27/04; B66C 17/08; F23K 3/00

[58] Field of Search ..... 202/262, 263; 201/40; 214/18 PH, 35 R, 21 R, 18.26; 110/110

[56] References Cited

UNITED STATES PATENTS

| | | | |
|---|---|---|---|
| 1,423,314 | 7/1922 | Fiechtl | 214/18 PH |
| 1,813,262 | 7/1931 | Snyder | 214/18.26 |
| 3,716,150 | 2/1973 | Echterhoff | 202/263 |
| 3,880,720 | 4/1975 | Wagener et al. | 202/262 |

*Primary Examiner*—Wilbur L. Bascomb, Jr.
*Assistant Examiner*—Barry I. Hollander
*Attorney, Agent, or Firm*—Brown, Murray, Flick & Peckham

[57] ABSTRACT

A charging car supports a plurality of hoppers in a manner such that two hoppers for supplying coal to adjacent charging holes are supported one after the other in a consecutive relationship along a line which is generally parallel to movement by the charging car. A conveyor conducts coal from each hopper to a telescopic charging tube which communicates with the charging hole in the roof of a coking chamber. Skirt-like walls enclose the sides of the spaces containing two of the hoppers to conduct smoke and other gases upwardly toward a roof which is supported by stanchions at each side of the battery of coke ovens. In one embodiment, two roof sections extend from the sides of a battery of coke ovens toward the center thereof. Gas-conducting mains receive gases via outlet pipes having control valves from the spaces beneath the roofs.

10 Claims, 6 Drawing Figures

CHARGING CAR FOR COKE OVENS

BACKGROUND OF THE INVENTION

This invention relates to a charging car adapted to move above a battery of coke ovens, and more particularly to such a car including hoppers associated with charging holes aligned in rows which extend parallel to the longitudinal axes of the coking chambers. The present invention is specifically directed to a novel charging car having an improved construction and relationship of parts to provide unobstructed gangways for workmen to move along the oven roof.

The size of the hoppers on a charging car for a battery of coke oven chambers has increased to meet the demand for increased volumes of coal to be heated in the chambers of the coke ovens for the purpose of dry distillation. Larger volumes of coal are required because the height of the coking chambers has been increased to fulfill present-day requirements for a greater quantity of coke from each coking chamber. As is known, a charging car supports these hoppers in a generally side-by-side relation so that they extend substantially across the entire width of the battery of coke ovens at the top thereof. This is particularly undesirable because it prevents access to the top of the battery of coke ovens along the length thereof for the purpose of performing servicing operations. Thus, for example, it is difficult for workmen to check the heating flues between the coking chambers through inspection openings in the oven roof because of the constant need for the workmen to get out of the way as the charging car passes by them along the oven roof.

Free space on a coke oven roof is particularly restricted when there is a gas-collecting main and associated ascension pipes which are also near the oven roof at the coke side as well as at the machine side of the coke ovens. Notwithstanding the added expense for material and labor, the use of two gas-collecting mains has become increasingly popular for several reasons. These reasons include a reduction to the pressure load of the gases. Moreover, when a gas main is used to separately extract the gases liberated during the charging of coal into the coking chambers so as to reduce atmospheric pollution, then the use of two gas-conducting mains is required to separately extract and discharge the distillation gases liberated during different phases of the distillation process.

SUMMARY OF THE INVENTION

It is an object of the present invention to provide a novel charging car construction designed to overcome serious operational disadvantages brought about by restricted access to the top of a battery of coke oven chambers by known forms of charging cars.

It is a further object of the present invention to provide an improved construction and arrangement of parts to form a novel charging car employed to load coal into a plurality of charging holes for each oven chamber in a battery thereof while providing an unobstructed access space for workmen on the oven roof and at the same time reducing atmospheric pollution due to gases liberated during coal charging operations.

More specifically, according to the present invention there is provided a coal charging apparatus adapted to move along the top of a battery of coke ovens wherein the roof for each coking chamber includes a row of spaced-apart charging holes which are aligned in a substantially parallel relation with the axis of the coking chamber, the row of charging holes being covered by lids which are removable when feeding a charge of coal into the coking chamber, the coal charging apparatus comprising the combination of a charging car adapted to move along the top of the battery of coke ovens from oven-to-oven while spaced above the charging holes for the coking chambers, a plurality of hoppers which essentially includes a hopper for supplying coal to each charging hole lying within an aligned row thereof for a given coking chamber, the hoppers being supported by the charging car in a manner such that two hoppers for supplying coal to adjacent charging holes within a given row thereof are supported one after the other in a substantially consecutive relationship along a line which is generally parallel to the direction of movement by the charging car, a charging tube for each of the hoppers to direct coal into a charging hole, and conveyor means for each charging tube to conduct coal thereto from a hopper.

Thus, according to the present invention the hoppers associated with adjacent charging holes are disposed on the charging car so as to be located in a substantially consecutive relationship to one another in the direction of movement by the charging car and a transverse conveyor is provided between a hopper outlet and a telescopic charging tube which is adapted to be placed upon the frame that normally supports a lid used to cover a charging hole. The aforesaid transverse conveyor can be screw-type conveyors, scraper chain conveyors or the like. The transverse conveyors or their frames are pivotal about vertical axes located near the outlets of the hoppers so as to pivot out of the way or otherwise leave a free space immediately above the charging holes for automatic lifting and replacement of the lids for the charging holes. It is preferred that two hoppers and associated charging pipes form an associated group thereof on the charging car. Since the hoppers are the elements which have the greatest bulk on the charging car, a group comprising two hoppers disposed consectively is much narrower than a group comprising two hoppers disposed one beside the other. Irrespective of the total number of charging holes provided in a roof for a given oven chamber, the present invention enables a construction of the charging car to provide a gangway of adequate width and located outwardly of the charging car between it and a gas-collecting main which may be present on the roof of the battery of coke ovens.

By the novel construction of a charging car according to the present invention, a gangway extending over the length of a battery of coke ovens can readily be provided in the central zone of the charging car when the movable frame of the charging car is positioned at an elevation which is high enough to allow for the passage of workmen along the gangway. The free space provided by such a gangway near the longitudinal center of the coke oven battery can also be employed to accommodate a gas-collecting main with takeoff pipes rising substantially from the center of the gas-collecting chamber. Such an arrangement of the gas-collecting main was commonly employed in earlier coke oven designs when the oven chambers were charged with coal from individual charging trucks that moved along the top of the oven battery for each charging hole in a given coking chamber. A central gas-collecting main of this kind may take the form of a double gas-collecting main to thereby enable the carrying out of gas-collecting processes which have usually been performed with two separate gas-collecting mains.

It is known to enclose the top of an individual charging hole with a hood-like box or the like. The interior of the box was connected to an extractor main used to conduct the gases evolved during the charging operation. The gases were then cleaned, burned or fed into a chimney. When side-by-side hoppers are arranged to feed coal into the charging holes disposed along a given coking chamber axis, it is known to provide a vertically-movable hood which is adapted to rest in a bottom position upon the top of the oven roof and bound the area in which all the charging holes of a single oven chamber are disposed. Such a hood includes an extractor for the gases evolved during a charging operation. The idea of reducing atmospheric pollution by the gases evolved during the coal charging operations for a battery of coke oven chambers can be carried into effect even more readily with the novel charging car arrangement of the present invention, particularly when hood-like barriers are provided in each case for two charging holes so that such barriers enclose a space containing two consecutively-arranged hoppers and the associated transverse conveyors and charging pipes. It is preferred to employ skirt-like walls to enclose the sides of such a space whereby the walls extend downwardly to the oven crown and extend upwardly to an associated roof surface having provisions for the extraction of the evolved gases.

The novel charging car according to the present invention is adapted to run along rails placed directly upon the oven roof. Alternatively, the novel charging car moves along rails located above the furnace roof. In this event, the rails are carried by a frame supported by stanchions at both sides of the battery near the oven tops. In the latter form of support for the charging car, the rails are preferably placed upon longitudinal members carried by cantilever-like supports which extend inwardly from the stanchions above the coke oven roof. The movable frame of the charging car and support structure therefor are positioned at an essentially higher elevation which is independent of the height of the coke oven roof. This insures relatively undisturbed access by operating personnel to gangways or passageways provided between groups of consecutively-arranged hoppers below the charging car and its support structure.

The stanchions at each side of the battery of coke ovens may be extended vertically by longitudinal walls that are connected along their top edges by roof members which are inclined and extend in a downward direction toward the center of the top of the oven chambers. Such an arrangement of parts provides, at both the coke side and the machine side, a space beneath the roof which extends along the whole length of the battery of coke ovens. This space is connected by way of closable connections to gas extractor mains extending along the length of the battery of coke ovens. The space, enclosed by the skirt-like walls containing the hoppers, transverse conveyors and charging pipes, merges at the top thereof into a space below one of the inclined roof members. This has the desirable advantage that any gases issuing from a charging hole during the charging of a coke oven chamber can be collected and decontaminated.

These features and advantages of the present invention as well as others will be more readily understood when the following description is read in light of the accompanying drawings, in which.

Figure 1:
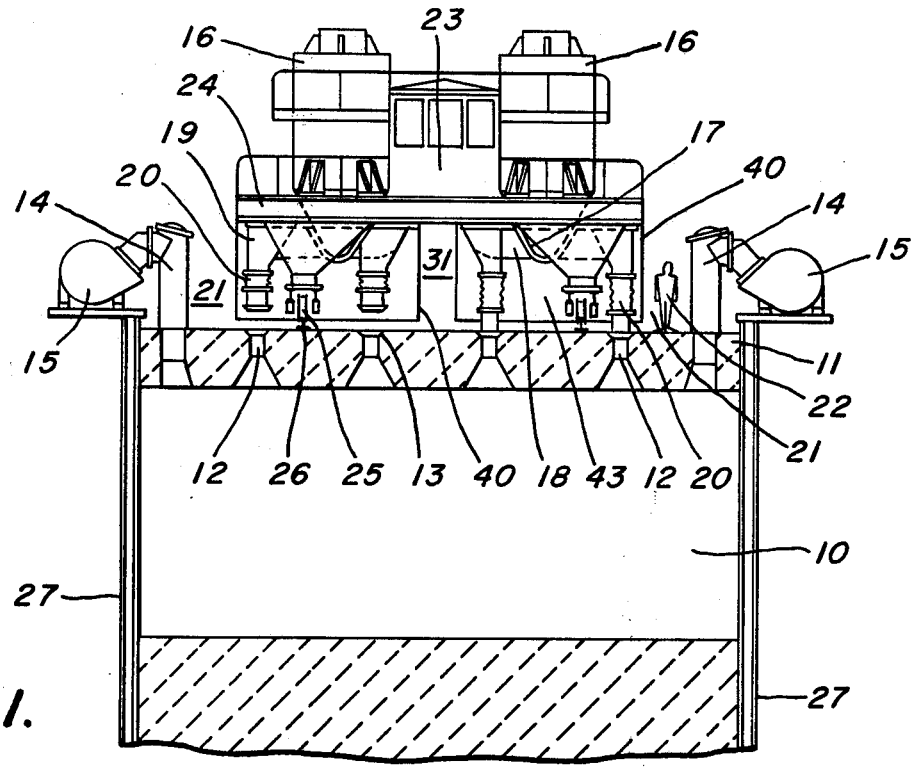
FIG. 1 is an elevational view of the novel charging car supported upon the roof of a coke oven chamber which is shown by a sectional view along the length of the chamber.

In the drawings, there is illustrated a coke oven chamber 10 which forms one of a battery of coke oven chambers that additionally includes an oven crown or roof 11. A plurality of charging holes 12 is provided in the oven roof and for the purpose of illustrating the present invention, an aligned row of four charging holes is shown for each coking chamber. Frames 13 are provided to support removable lids in the usual well-known manner. Buckstays 27 support the oven masonry at each end of a coking chamber; that is, at the coke side and the machine side. The coking chamber 10 shown in FIGS. 1 and 2 communicates with gas takeoff or ascension pipes 14 connected to gas-conducting mains 15 that extend along the coke side and the machine side of the coke oven battery. In FIG. 1, the charging car includes a frame 24; while in FIGS. 2–6, a corresponding type of frame 24A forms part of the charging car. Each form of charging car is supported by wheels 25. As shown in FIG. 1, the wheels 25 run along rails 26 supported upon the oven roof of a battery of coke ovens.

Figure 2:
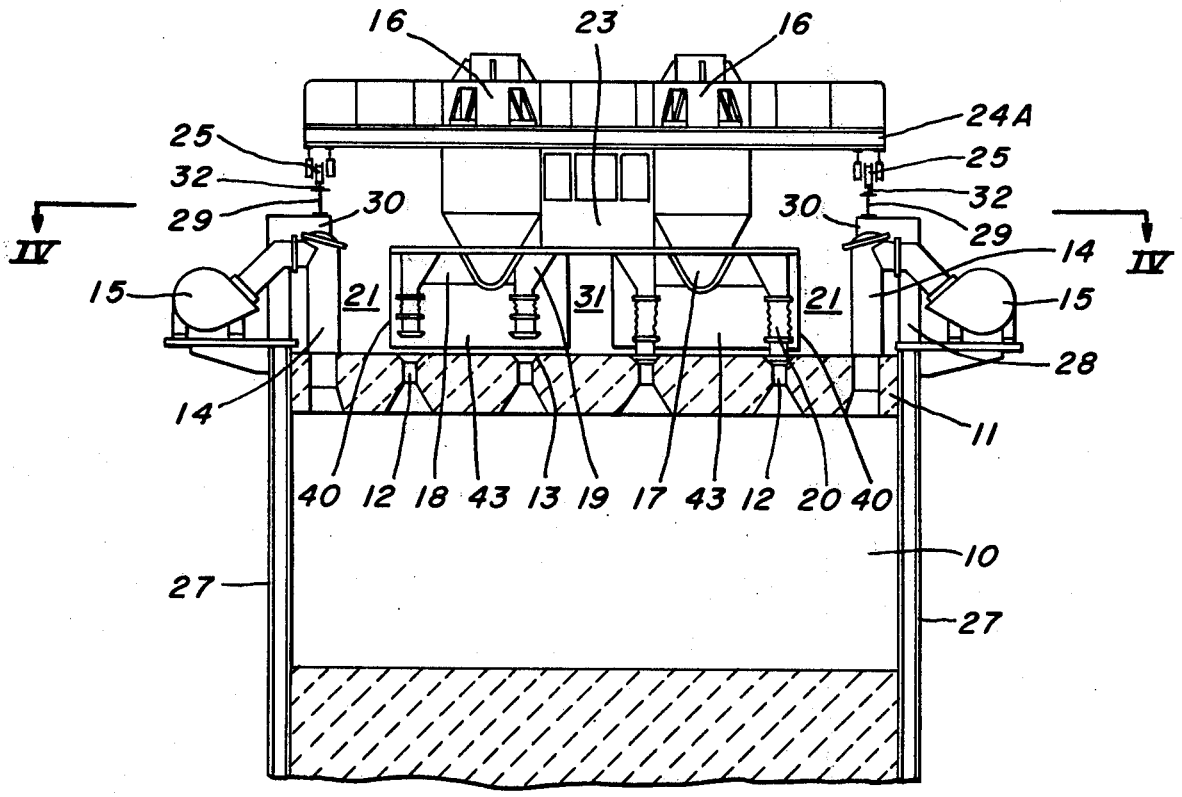
FIG. 2 is a view similar to FIG. 1 and illustrating a different form of support for the charging car independent of the oven roof.
Figure 3:
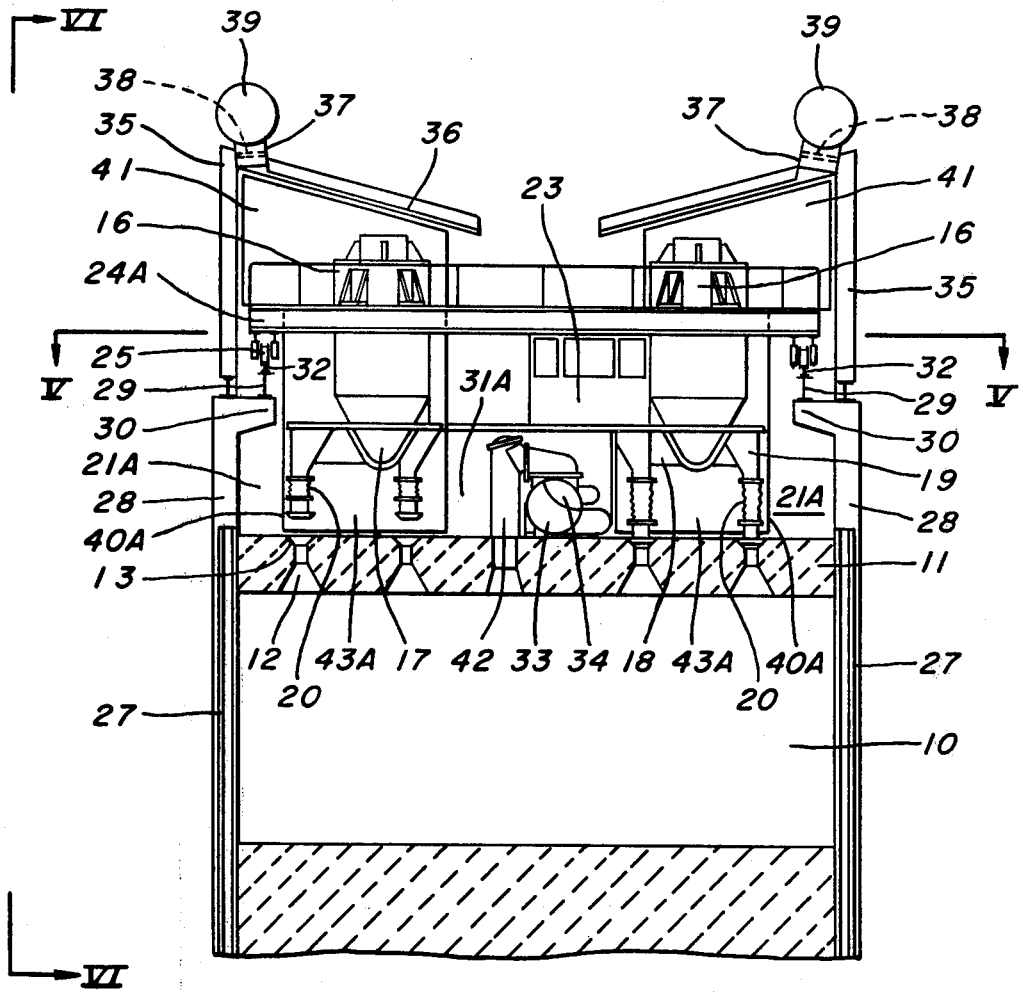
FIG. 3 is a view similar to FIG. 2 and illustrating the relationship of a centrally-located gas-collecting main on the roof.
Figure 4:
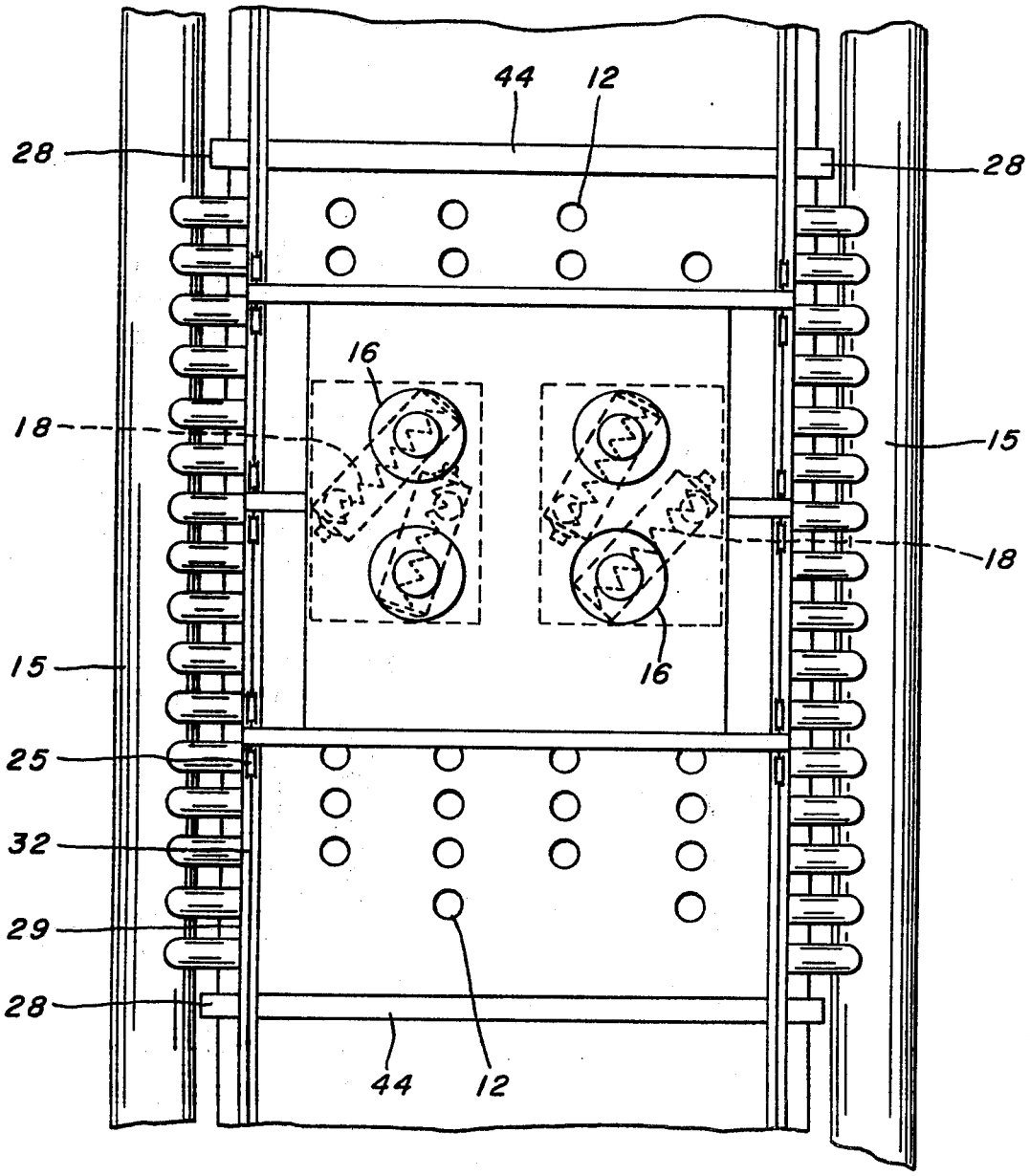
FIG. 4 is a sectional view taken along line IV—IV of FIG. 2.
Figure 5:
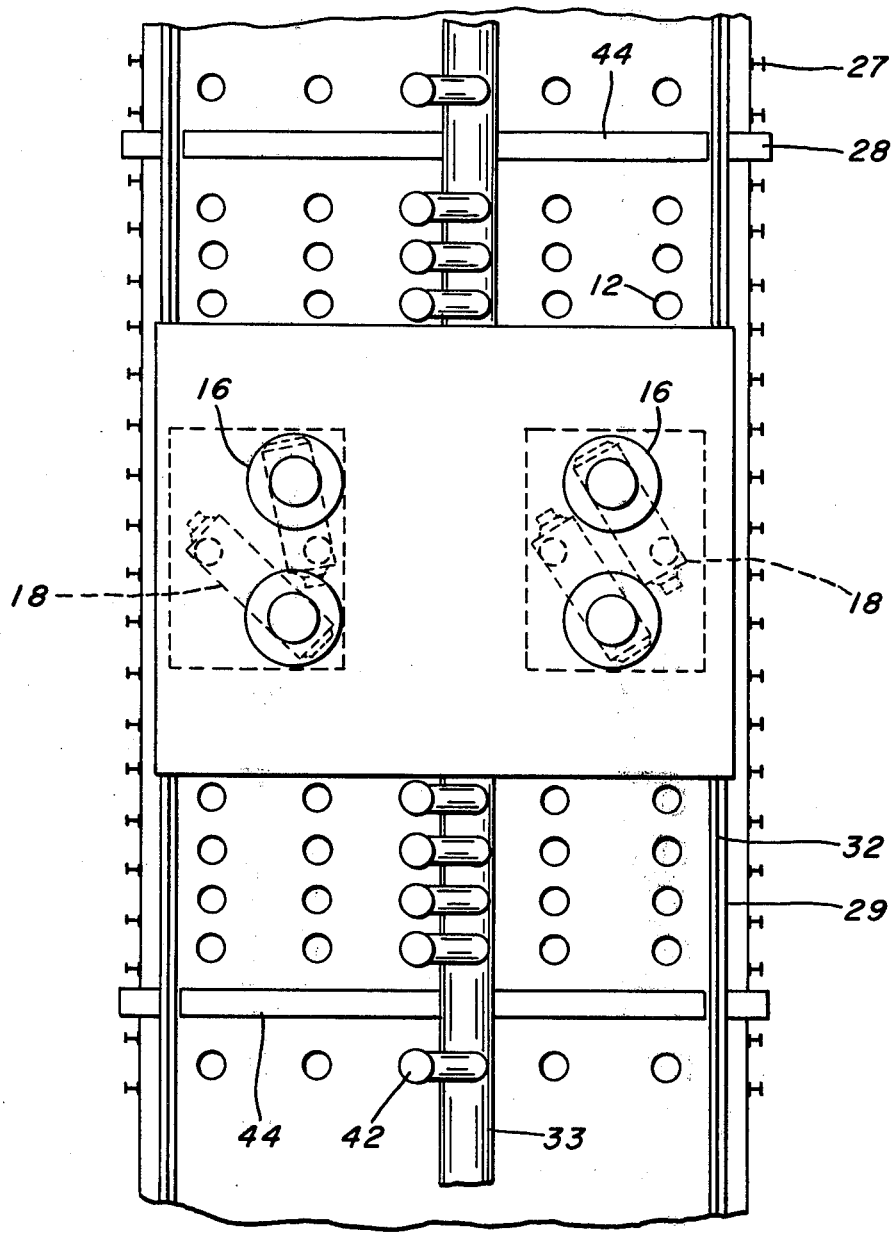
FIG. 5 is a sectional view taken along line V—V of FIG. 3.
Figure 6:
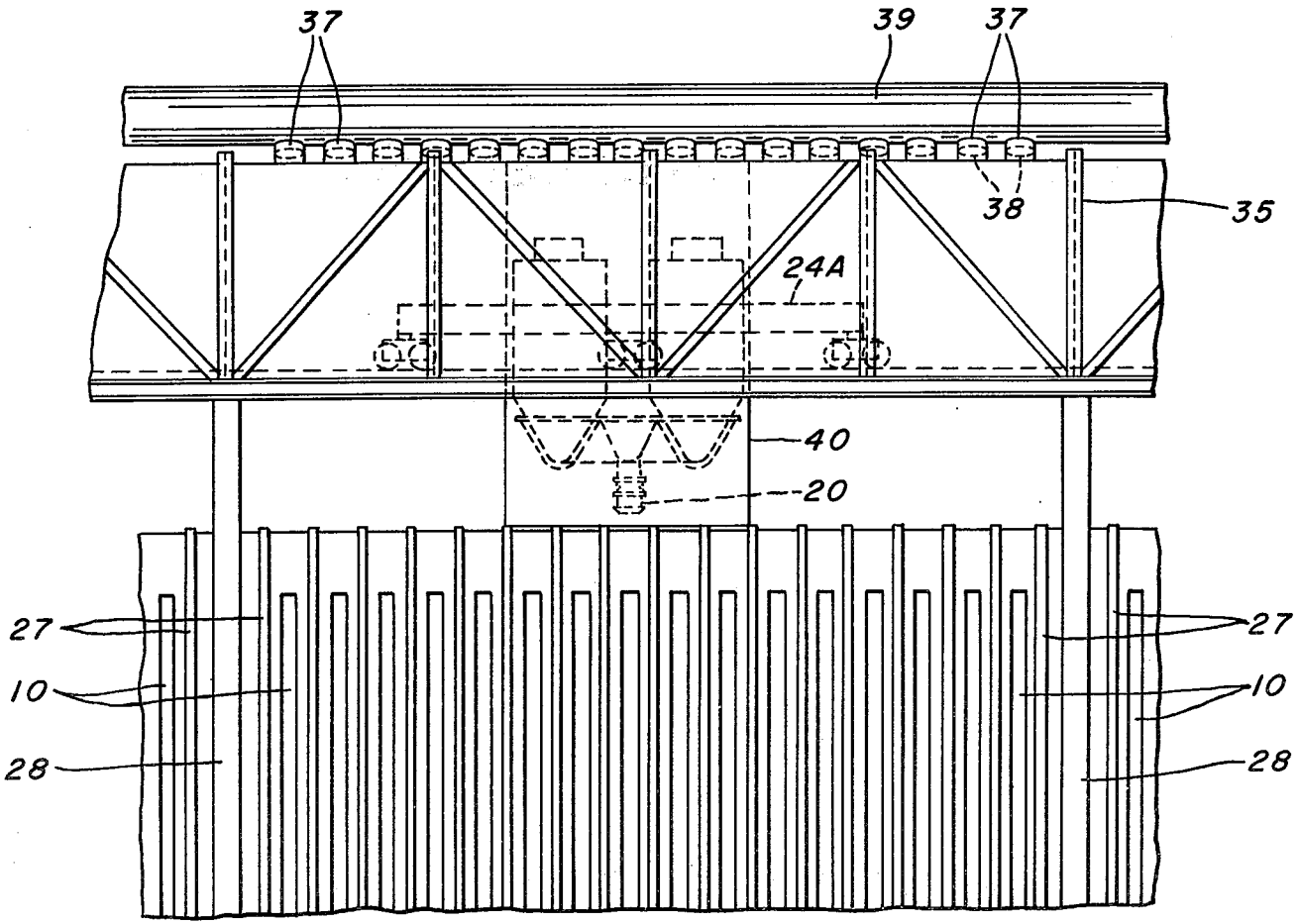
FIG. 6 is a side elevational view taken along line VI—VI of FIG. 3.

In FIGS. 2 and 3, and illustrated correspondingly in FIGS. 4–6, the coke oven battery is subdivided into units of sixteen coke oven chambers. Such a divided unit of coking chambers is best shown in FIG. 6. Stanchions 28 extend upwardly at intervals of, for example, sixteen oven chambers at the coke side and the machine side thereof. The stanchions project above the roof of the battery of coke ovens to support a frame used to carry the tracks for supporting the charging car. More specifically, cantilever-like supports 30 project inwardly from the tops of the stanchions 28 and carry longitudinally-extending members 29 that, in turn, support rails 32 for the wheels of the charging car. Intermediate walls 44 between two coking chambers interconnect two stanchions located at opposite sides of a coking chamber.

The underlying concept of the present invention can best be understood by referring to FIGS. 4 and 5. As shown, a plurality of hoppers 16 is supported by a charging car. Four such hoppers are shown and they are supported by the charging car in a spaced-apart arrangement to form a two-by-two array. More specifically, these hoppers are employed to separately supply coal to a charging hole lying within an aligned row thereof for a given coking chamber. The hoppers are supported in a manner such that two of the hoppers for supplying coal to adjacent charging holes within a given row thereof are arranged one after the other in a substantially consecutive relationship along a line which is generally parallel to the direction of movement by the charging car along the battery of coke oven chambers. Each of the hoppers 16 has a bottom outlet 17 which communicates by way of a transverse screw conveyor 18 with the top entrance to a charging pipe 19. Each transverse conveyor 18 is pivotally connected for movement about a vertical axis extending within the outlet 17. The charging pipes 19 include resilient intermediate members 20 whereby these pipes are extendible in a telescopic manner for placement into a sealed engagement with the frames 13 used to support the lids for the charging holes. The charging pipes 19 may take the form of tubes or bellows although other known forms of charging pipes may be employed for engaging the frames 13.

In accordance with the preferred form of a charging car according to the present invention, vertical wall-like skirts enclose the sides of a space containing two consecutively-arranged hoppers together with the associated transverse conveyor and charging pipes. More specifically, in FIGS. 1 and 2, there is illustrated vertical skirts 40 that form side walls to a space 43 in which two hoppers 16 are located while supported by the charging car in a consecutive relation as hereinbefore described. Also contained within the space 43 defined by the skirts 40 is a conveyor 18 for each hopper and a charging pipe 19 to discharge coal from each conveyor into a charging hole. In a similar manner, two consecutively-arranged hoppers 16 shown in in FIG. 3 each with an associated conveyor 18 and charging pipe 19 are located within a space 43A which is bounded by vertical wall-like skirts 40A. The spaces 43 enclosed by the skirts 40 are connected to an extractor, not shown in FIGS. 1 and 2. In FIG. 3, the skirts 40A extend upwardly to a greater extent than the corresponding skirts 40 shown in FIG. 2. The top edges of the skirts 40A terminate in roof spaces 41 which extend at both the coke side and the machine side along the entire length of a battery of coke ovens. The roof spaces 41 are bounded by longitudinal walls 35 which are supported on the tops of the stanchions 28 at both the machine side and the coke side. The roof spaces 41 are further defined by roof members 36 which extend in a downwardly-inclined manner from the top edges of the walls 35. As best shown in FIG. 6, outlet pipes 37 each having a valve 38 are located at spaced intervals along the entire length of each roof member 36 to extract gases from the spaces 41. The outlet pipes extend through the roofs and communicate with one of two continuous collector mains 39. These mains are connected to facilities for processing or decontaminating the gases evolved during the charging operation.

The underlying concept of the novel charging car of the present invention particularly resides in the arrangement of two hoppers 16, one behind the other, for adjacent charging holes while supported by the charging car together with the concept of elevating the frame 24 of the charging car so that freely-accessible gangways extend along the entire length of the battery of coke ovens for access to the top or roof thereof.

Thus, for example, according to the embodiment shown in FIGS. 1 and 2, gangways 21 are formed, each with a sufficient width to accommodate operating personnel, diagrammatically illustrated by reference numeral 22. These gangways extend along the battery of coke ovens in the space between the gas takeoff pipes 14 and the charging car. A further passageway or gangway 31 is located in the middle of the charging car and remains unobstructed by movements of the charging car. FIG. 3 illustrates the manner by which the central passageway or gangway can be utilized to accommodate ascension pipes 42 which are connected to a double gas-collecting main of a known design. This main consists of a principal gas-conducting main 33 and a secondary gas-conducting main 34. The control cabin 23 for the charging car as well as the frame 24 thereof are positioned at an elevation which is sufficiently above the oven roof to maintain the unobstructed nature of the central passageway.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. A coal charging apparatus adapted to move along the top of a battery of coke ovens wherein the roof for each coking chamber includes a row of spaced-apart charging holes which are aligned in a parallel relation with the longitudinal axis of the coking chamber, the row of charging holes being covered by lids which are removable to feed a charge of coal into the coking chamber, said coal charging apparatus comprising the combination of:

a charging car adapted to move along the roof of the battery of coke ovens from oven-to-oven while spaced above the charging holes for each coking chamber, a plurality of hoppers which essentially includes a hopper for supplying coal to each charging hole lying within an aligned row thereof for a given coking chamber, said plurality of hoppers being supported by said charging car in a manner such that two hoppers for supplying coal to adjacent charging holes within a given row thereof are supported one after the other in a substantially consecutive relationship extending parallel to the direction of movement of the charging car along the coke ovens, a charging tube for each of said plurality of hoppers for directing coal into a charging hole, and conveyor means for each charging tube for conducting coal thereto from one of said plurality of hoppers.

2. The charging apparatus according to claim 1 wherein said charging tube is extendible in a telescopic manner between an associated one of said conveyor means and a charging hole.

3. The charging apparatus according to claim 1 wherein said conveyor means for each charging tube is further defined to include a screw-type conveyor.

4. The charging apparatus according to claim 1 wherein said conveyor means is connected to the coal discharge outlet of an associated one of said hoppers for pivotal positioning of the conveyor means at said coal discharge outlet about a vertical axis.

5. The charging apparatus according to claim 1 wherein said charging car and said plurality of hoppers supported thereby are spaced inwardly from the ends of the coke ovens in a manner to thereby define gangways extending along the length of the battery of coke ovens in a direction which is parallel to the movements of said charging car along the battery of coke ovens.

6. The charging apparatus according to claim 1 further comprising means for supporting said charging car in a spaced relation above the top of the battery of coke ovens while said charging car supports pairs of said plurality of hoppers in a spaced-apart relation in a manner to thereby define a gangway extending along the length of the battery of coke ovens in a direction which is parallel to the movements by said charging car therealong.

7. The apparatus according to claim 1 further comprising skirt walls enclosing the sides of the spaces which contain two of said plurality of hoppers, the hoppers enclosed by said skirt walls being arranged one after the other in a substantially consecutive relationship along the direction which is parallel to the movement by the charging car along the coke ovens, said skirt walls extending substantially to the roof of the coke ovens, and roof means including gas-extracting means overlying the upper end of said skirt walls above the coke ovens.

8. The charging apparatus according to claim 1 further comprising stanchions at both sides of the battery of coke ovens extending above the roof of the coking chambers, frame means carried by said stanchions at both sides of the battery of coke ovens to support said charging car, skirt walls enclosing the sides of a space which contains at least some of said plurality of hoppers together with said conveyor means and said charging tube associated therewith, vertical walls supported by said stanchions extending in a longitudinal direction along the sides of the battery of coke ovens, roof members extending in a downwardly-inclined manner from the upper edge of said vertical walls above said charging car in the general direction toward the center of the battery of coke ovens, and a gas main extending along the battery of coke ovens to exhaust gas from the space underlying said roof members.

9. The charging apparatus according to claim 8 further comprising outlet pipes extending between said gas main and a roof member to conduct gas into the gas main, and valve means associated with said outlet pipes for controlling the passage of gas therethrough.

10. The apparatus according to claim 9 wherein said gas main extends along each roof member at the vertical support wall therefor.

* * * * *